US006220840B1

(12) United States Patent
Calhoun et al.

(10) Patent No.: US 6,220,840 B1
(45) **Date of Patent: *Apr. 24, 2001**

(54) WALL SHAPE FOR SCROLL-TYPE COMPRESSOR VANES

(75) Inventors: John L. Calhoun, Dallas; David W. McClung, Sachse, both of TX (US)

(73) Assignee: Sanden International (U.S.A.), Inc., Wylie, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/100,142

(22) Filed: Jun. 18, 1998

Related U.S. Application Data

(63) Continuation of application No. 08/733,255, filed on Oct. 18, 1996, now Pat. No. 5,836,752.

(51) Int. Cl.[7] ..... F01C 1/04
(52) U.S. Cl. ..... 418/55.2; 418/150
(58) Field of Search ..... 418/55.2, 150

(56) References Cited

U.S. PATENT DOCUMENTS

| | | | |
|---|---|---|---|
| 801,182 | 10/1905 | Creux | 418/55.2 |
| 4,477,239 | 10/1984 | Yoshii et al. | 418/55.2 |
| 4,547,137 | 10/1985 | Terauchi et al. | 418/55.2 |
| 5,151,020 | 9/1992 | Mori et al. | 418/55.2 |
| 5,318,424 | 6/1994 | Bush et al. | 418/55.2 |
| 5,425,626 | 6/1995 | Tojo et al. | 418/55.2 |
| 5,554,017 | 9/1996 | Kohsokabe et al. | 418/55.2 |

FOREIGN PATENT DOCUMENTS

| | | | |
|---|---|---|---|
| 64-63680 | 3/1989 | (JP) | 418/55.2 |
| 4-124483 | 4/1992 | (JP) | 418/55.2 |

OTHER PUBLICATIONS

Bush, et al., "Maximizing SCroll Compressor Displacement Using Generalized Wrap Geometry," *Proceedings, 1994 International Compressor Engineering Conference at Purdue,* Purdue University, 1994, pp. 205–210.

*Primary Examiner*—John J. Vrablik
(74) *Attorney, Agent, or Firm*—Baker Botts L.L.P.

(57) ABSTRACT

A fluid displacement apparatus is provided. The apparatus can be in the form of a scroll element for a scroll-type fluid compressor. The apparatus has first and second scrolls. The scrolls themselves, as well as the space between the scrolls may be defined by a spiral shape. The spiral shape may have either a constant pitch or a non-constant pitch.

7 Claims, 9 Drawing Sheets

FIG. 3
(PRIOR ART)
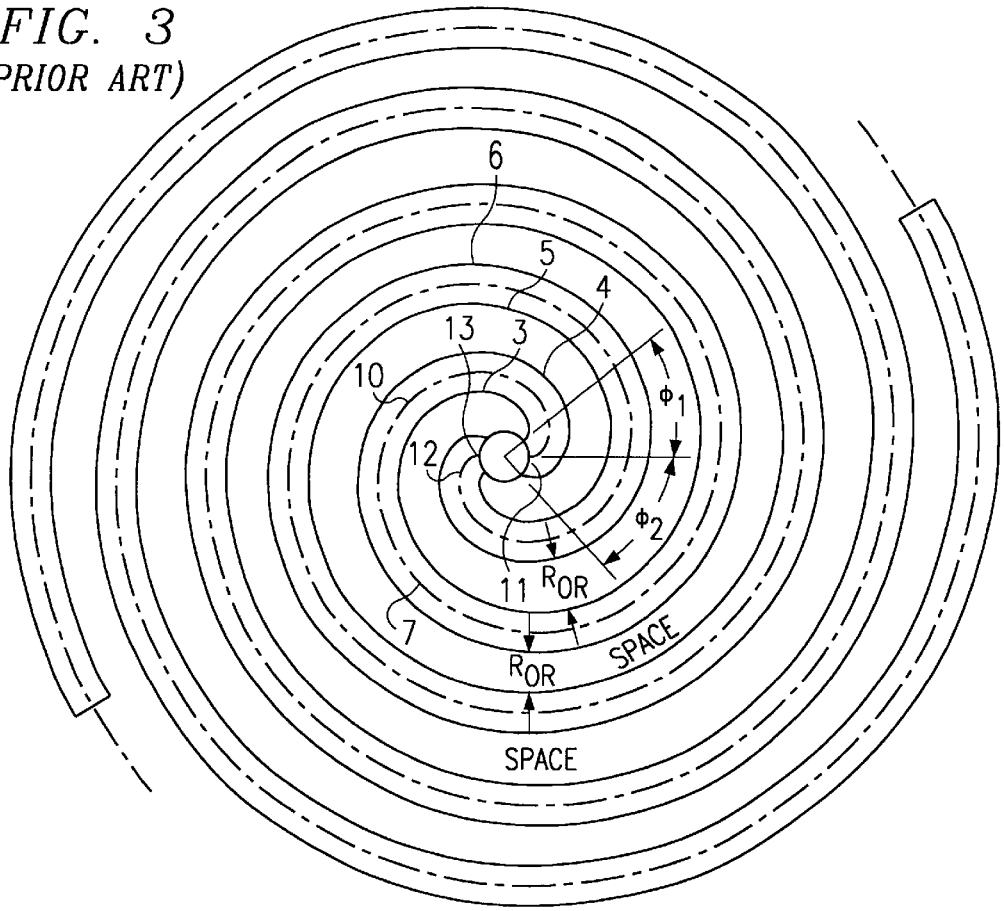
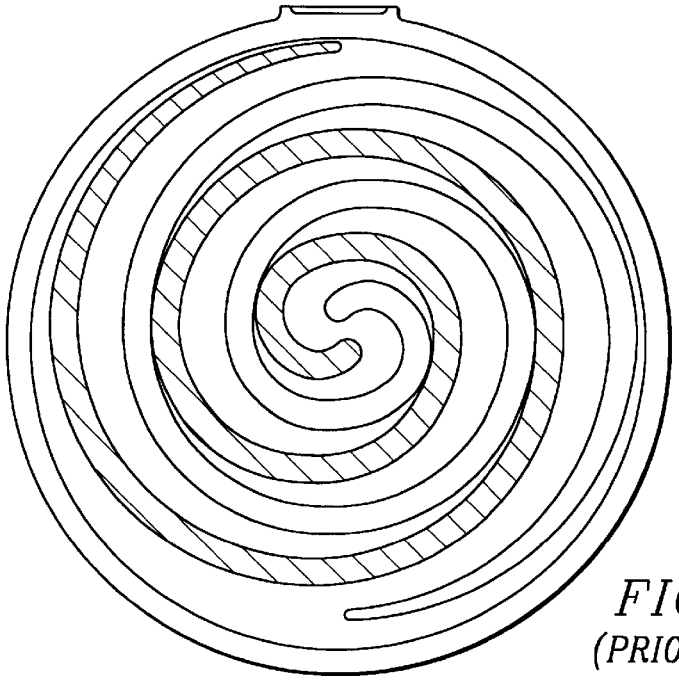
FIG. 4
(PRIOR ART)

FIG. 8A
(PRIOR ART)
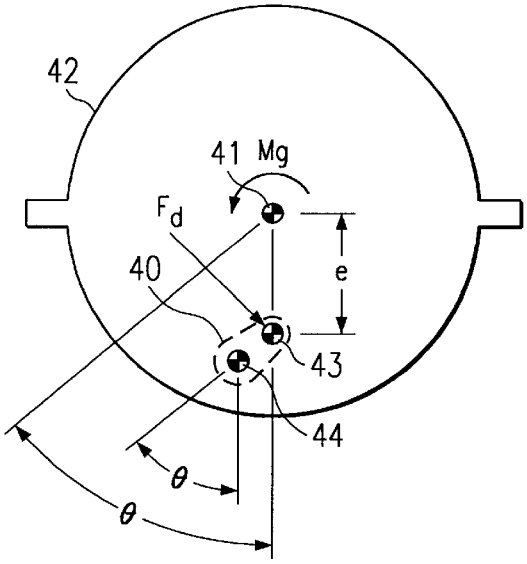
FIG. 8B
(PRIOR ART)
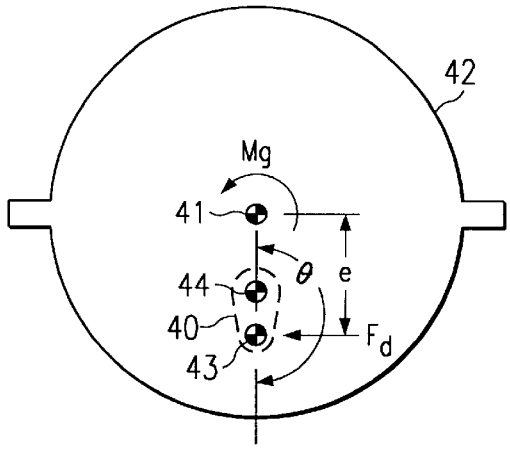
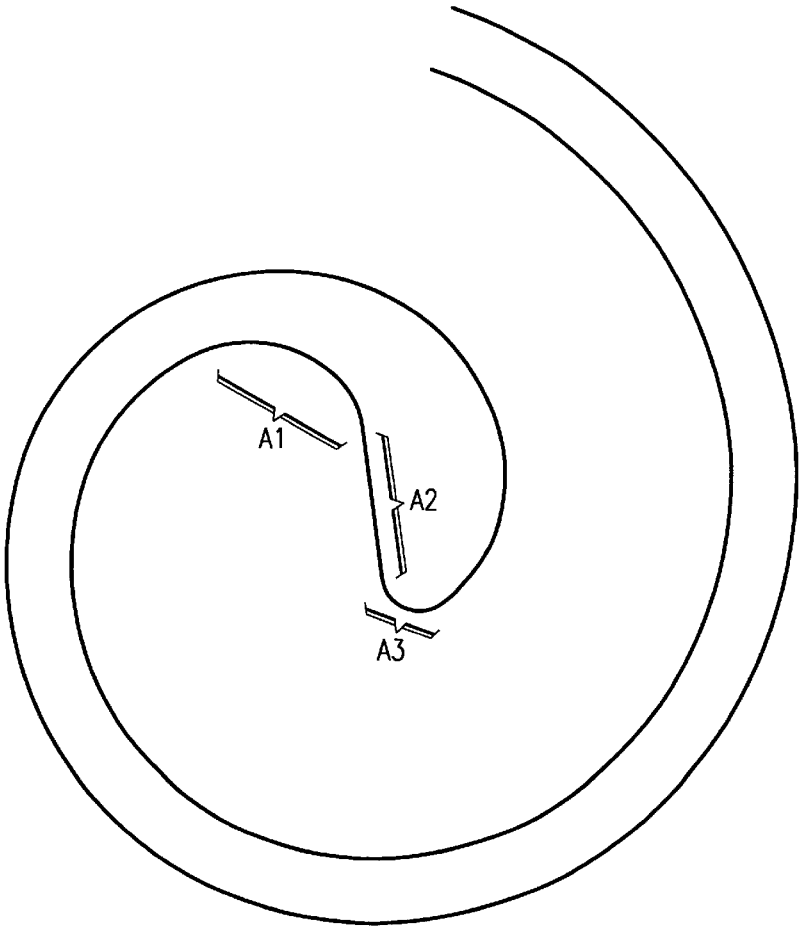
FIG. 9
(PRIOR ART)

FIG. 10
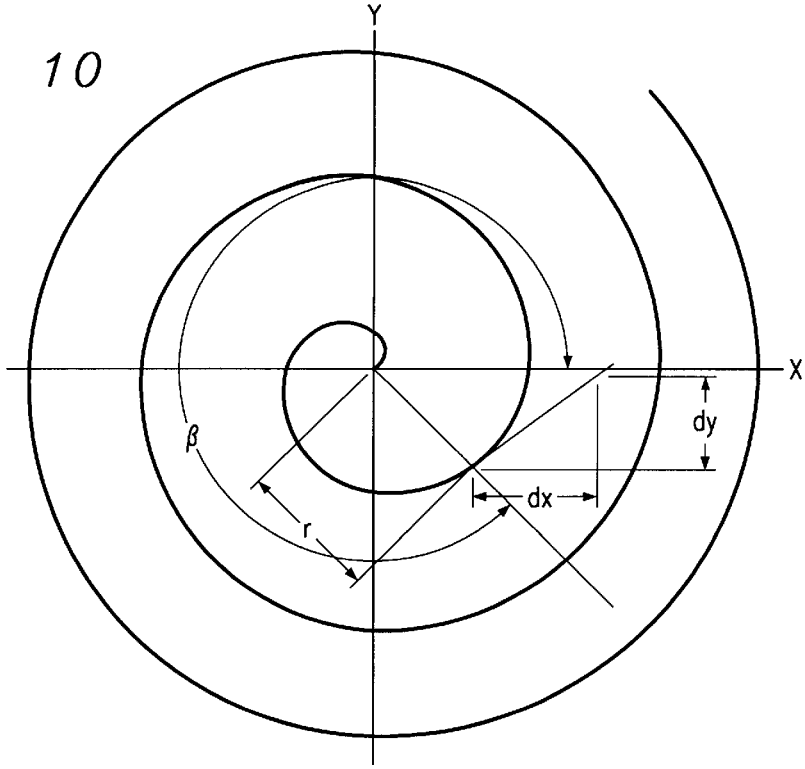
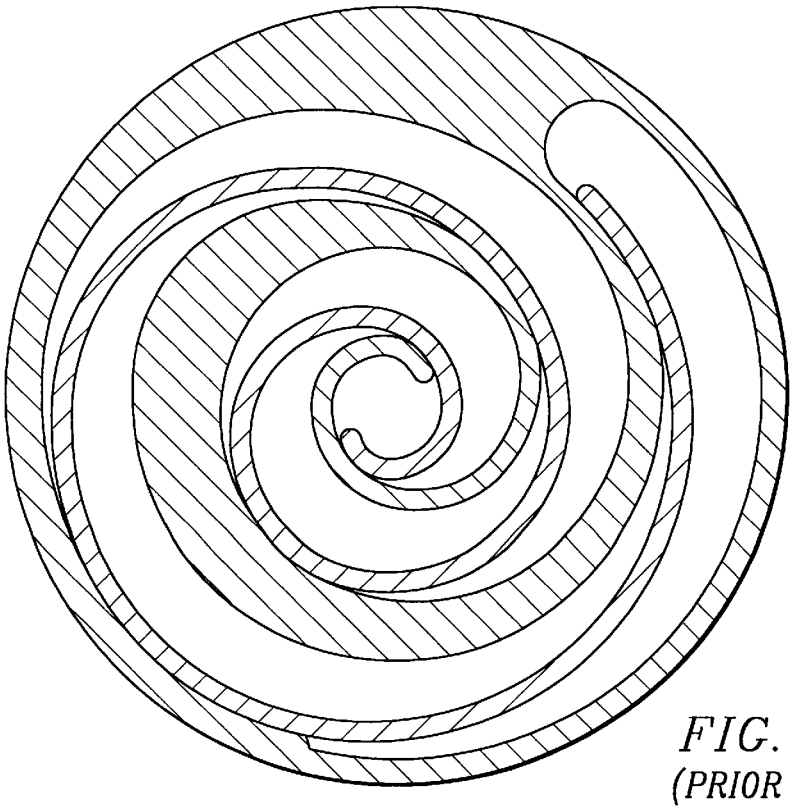
FIG. 11
(PRIOR ART)

FIG. 12
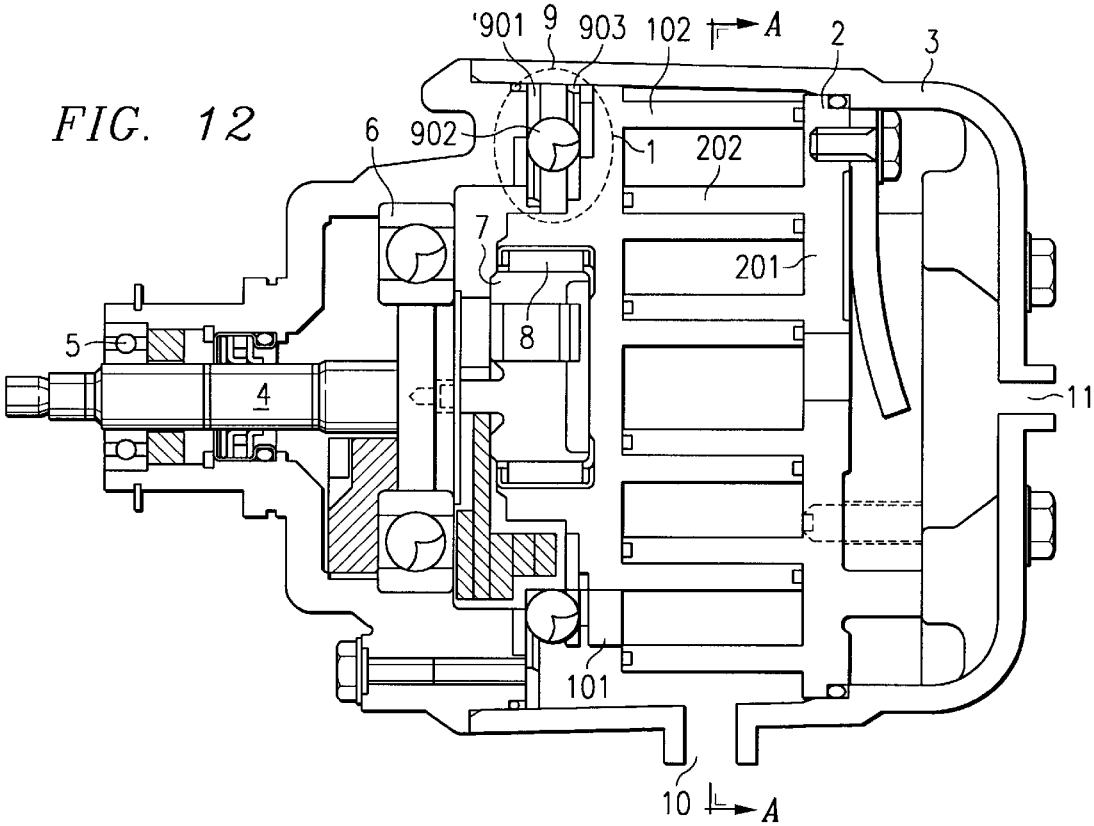
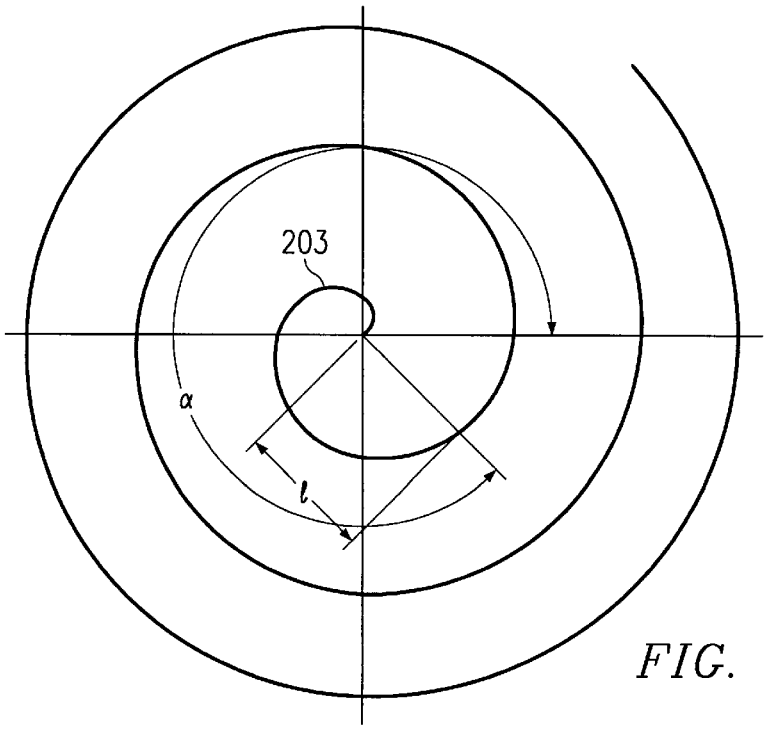
FIG. 13

FIG. 14
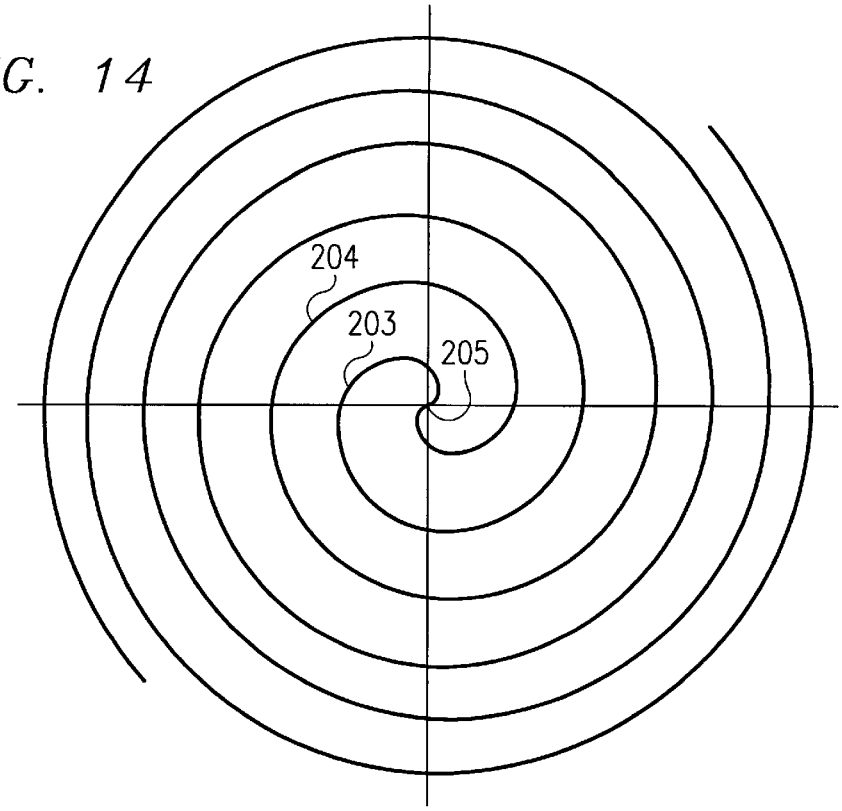
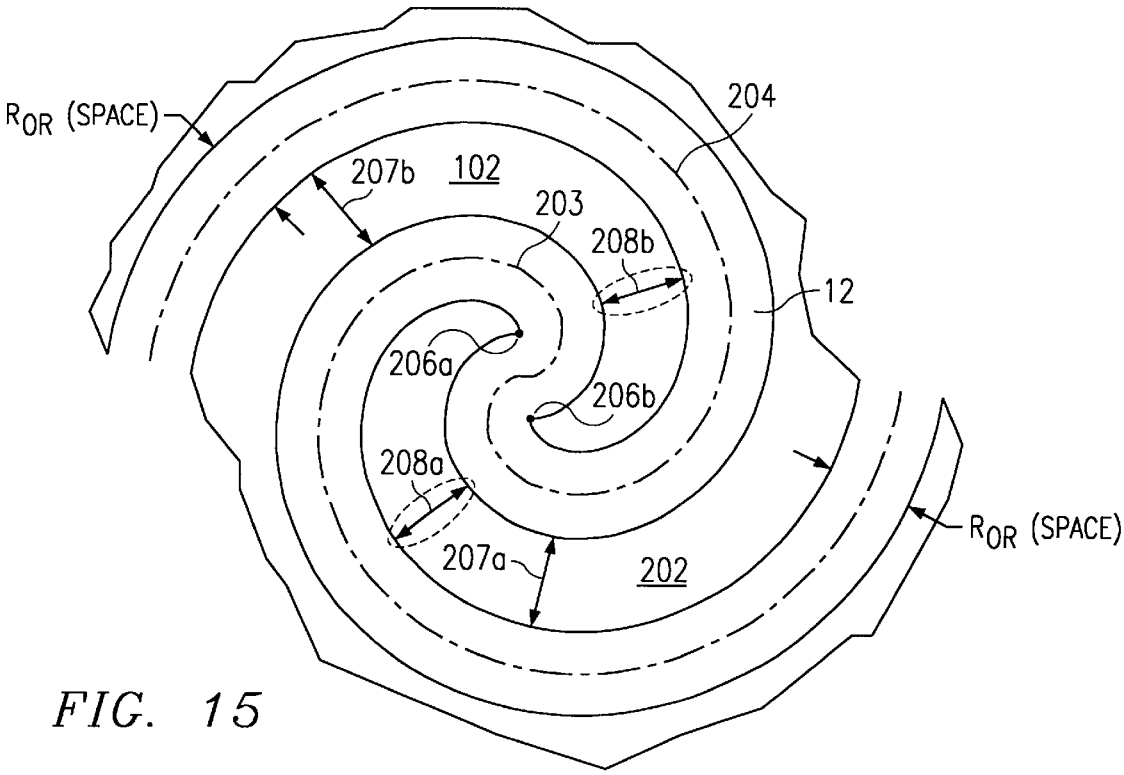
FIG. 15

WALL SHAPE FOR SCROLL-TYPE COMPRESSOR VANES

CROSS REFERENCE TO RELATED APPLICATIONS

This application is a continuation of application Ser. No. 08/733,255, filed Oct. 18, 1996, U.S. Pat. No. 5,836,752, by John L. Calhoun and David W. McClung entitled "Scroll-Type Compressor with Spirals of Varying Pitch."

This invention generally relates to fluid displacement mechanisms and, more particularly, to scroll-type fluid displacement mechanisms having scrolls of varying pitch.

BACKGROUND OF THE INVENTION

Scroll-type fluid displacement mechanisms are generally known. The general operation of such mechanisms is disclosed, for example, in U.S. Pat. No. 801,182 issued to Creux. Typically, these devices include a pair of scroll elements, each of which has an end plate and an involute wrap projecting from the end plate. The mechanism is usually structured such that the scrolls extend toward one another and are angularly and radially offset so that the involute scrolls interfit to make a plurality of line contacts between their curved surfaces to thereby seal off and define at least one pair of fluid pockets. Typically, one scroll element remains fixed, while the other scroll element orbits, without rotating, about the center of the fixed scroll element. The orbiting motion may be produced by a crank element rotated by a power supply. The relative orbital motion of the two scrolls shifts the line contacts along the involute curved surfaces of the scrolls and, as a result, the volume of the fluid pockets changes. Since the volume of the fluid pockets increases or decreases as a function of the direction of orbital motion, a scroll-type fluid displacement mechanism may be used to compress, expand or pump fluids.

As discussed, the scrolls of these devices are characterized by one or more involute curves. As shown in FIG. 1, for example, involute curve 10 defines the shape of a conventional form of a first scroll. Involute curve 10 of FIG. 1 can be described by the equation $l = r_g \cdot \phi$, where "l" is the length of a line segment 30 tangential to base circle 20 and extending from the tangent point 31 to a point 15 on curve 10, "$r_g$" is the radius of base circle 20, and "$\phi$" is the angular displacement from axis "x" (which passes through the starting point 11 of curve 10 and the center of the base circle) to a line extending outwardly from and perpendicular to line segment 30.

To create a pair of scroll elements capable of forming the desired fluid pockets, a second scroll is provided defined by involute curve 12, which starts at starting point 13 on the same base circle 20, but 180° offset from the first curve as shown in FIG. 2. As shown in FIG. 3, inner and outer walls 3 and 4 of the first scroll and inner and outer walls 5 and 6 of the second scroll are then defined by shifting the involute curves 10 and 12 about the center of base circle 20 by angles $\phi_1$ and $\phi_2$.

When the scrolls are designed by involute curves being separated by a distance $R_{or}$ (FIG. 3), then the walls of the scrolls may be brought into contact with each other to form a plurality of fluid pockets, as shown in FIG. 4. As one scroll moves in an orbiting path with respect to the other, the fluid pockets migrate toward the center of the scroll elements and their contents are eventually expelled at increased pressure and reduced volume from one or more ports near the center of the scroll elements (FIG. 5).

As shown in FIG. 6, this scroll-type apparatus has the disadvantage that a large area is unused near the outer periphery of the device (FIG. 6). As shown in FIG. 7, the center of the scroll pair may be offset from the center of the crank element in order to reduce this wasted space. However, this design causes a variation in the gas reaction forces experienced by an anti-rotation coupling, which is used to prevent rotation of the orbiting scroll. As depicted in FIG. 8A, the moment on the anti-rotation coupling becomes $M_c = -M_g - (e \cos \theta \times F_d)$, where Mg is the moment about the geometric center 41 of an orbiting scroll 42 due to pumping loads, $\theta$ is the angular offset of a crankshaft throw 40 from a line through the centers of the orbiting scroll and a scroll drive bearing 43, e is the offset of the scroll pair geometric center 41 from the center of scroll drive bearing 43, and where $F_d$ is the force applied to the scroll drive bearing 43 to cause the scroll to describe its orbital motion. It can be seen that under certain circumstances the moment on the anti-rotation coupling can reverse, thereby causing noise and durability problems. As shown in FIG. 8B, for example, $\theta = 180°$, hence $\cos \theta = -1$. Therefore, $M_c = -M_g + (e \times F_d)$. If $e \times F_d > M_g$, then $M_c$ can sometimes be positive and sometimes be negative.

Another problem in prior art scroll design concerns formation of the central portions of the scrolls. For example, when involute curves are used to define the surfaces of the scroll walls, these involute curves stop at the surface of the involute base circle as shown in FIG. 3. Therefore, in order to complete the center portion of the scroll wall, it has been necessary to deviate from the true involute curve. Wall segments A1, A2 and A3 in FIG. 9 show typical non-involute forms used at the center of a scroll defined by an involute curve.

One solution to the aforementioned problems might be to use a spiral curve (FIG. 10) to define the scroll. The spiral curve passes through the origin and does not require a base circle to be generated. FIG. 10 shows a typical spiral curve with a constant pitch, which can be described by the equation $r = c\beta$, where "r" is the distance from the origin to any point on the spiral curve, "$\beta$" is the angular offset from the "x" axis (which lies along the initial path of the spiral curve), and "c" is a constant. Since the spiral curve passes through the origin, as shown in FIG. 10, if a spiral curve could be used to define the shape of a scroll, it would not be necessary to deviate from the true curve near the center portion of the scroll. However, proper contact cannot be achieved when using spirals to define the surfaces of two scroll walls. For example, in FIG. 10, with $r = c\beta$, the slope of the spiral curve at $\beta$ is $dy/dx(\beta) = (\beta \cos \beta + \sin \beta)/(-\beta \sin \beta + \cos \beta)$. Thus, for a spiral curve, $dy/dx(\beta)$ is not equal to $dy/dx(\beta - 180°)$. By contrast, in the case of an involute curve, $dy/dx(\phi) = \tan(\phi)$. Thus, $dy/dx(\phi) = dy/dx(\phi - 180°)$. This structure permits the walls of the involute scrolls to come into contact without interference. Therefore, prior art scroll mechanisms have required that involute curves be used to define the scroll wall surfaces even though the central regions of the scrolls must deviate from the true form of the involute curve.

As shown in FIG. 11, another design technique has been employed, which involves using a hybrid spiral curve to generate the form of the scrolls. This method has the benefit that the available space in the apparatus is used more efficiently than if the scrolls are of the conventional circular involute form. However, the scrolls must of necessity be asymmetric which introduces unbalanced gas reaction forces into the mechanism.

In the operation of conventional scroll-type mechanisms, one of the most common causes of failure is breakage of the scroll walls due to the large cantilevered forces generated by the pressure differential across the scrolls. Current scroll designs are based on the assumption of constant wall thickness. Even the hybrid scroll concept described above relies on one wall being of constant thickness in order to make the design of the scroll pair manageable, as this design concept requires the use of curve fitting techniques in order to derive the shape of the curves. However, the gas force on the wall increases continuously toward the center of the scroll. As a result of using a constant wall thickness, the outer portion of the wall is overly thick for the low gas forces achieved, while the inner tip must be artificially increased in thickness. In order to thicken the inner tips of the scroll walls, their shapes must deviate greatly from that derived from the defining equation. Also, the excessive thickness of the outer portions of the wall means that wall material is taking up space which could be used for fluid compression. Further, the necessity to increase the thickness of the inner tips causes discontinuities in the gas compression process.

These are just examples of problems associated with prior art scroll design. It will be recognized by those having ordinary skill in the pertinent art that other problems and disadvantages result from the design of known scroll-type mechanisms.

SUMMARY OF THE INVENTION

It is an object of the present invention to provide a scroll-type fluid displacement mechanism having scrolls defined by spiral curves.

It is a further object of the present invention to provide a scroll-type fluid displacement mechanism having scrolls which contact each other without interference.

It is a further object of the present invention to provide a scroll-type fluid displacement mechanism with spiral scrolls having varying wall thicknesses. The scrolls may be thicker at the central regions than at the peripheral regions. This has the technical advantage of compensating for higher strength requirements at the central regions. This also has the technical advantage of providing larger pockets at the periphery for allowing greater intake of fluid.

It is a further object of the present invention to provide a scroll-type fluid displacement mechanism wherein the wall thicknesses of the spiral scrolls are varied in a smooth and progressively uniform manner. This has the technical advantage of allowing varying thickness while avoiding disturbances in the smooth displacement of fluid within the mechanism.

It is a further object of the present invention to provide a scroll-type fluid displacement mechanism wherein the available space within the mechanism is used efficiently with a minimum of wasted area. The scrolls may be centered on the axis of a drive mechanism so as to eliminate reversal of moments on an anti-rotation coupling. The scrolls may be of symmetrical construction so that fluid forces will be balanced within the mechanism.

It is a further object of the present invention to provide a method for design of scroll elements according to the previous objects.

To achieve these and other objects an apparatus is provided for displacing a fluid. The apparatus has first and second scrolls. The first scroll has a first vane and the second scroll has a second vane. The first vane is interleaved with the second vane to form at least one fluid pocket within the interleaved vanes. The apparatus also has entry and exit passages for entry and exit of the fluid into and out of the at least one fluid pocket. The apparatus also has a drive mechanism coupled to at least one of the scrolls to cause a relative orbital motion between the scrolls. This relative orbital motion causes the at least one fluid pocket to be displaced. A wall of each of the first and second vanes has a spiral cross section. In one embodiment, the spiral has a constant pitch. In another embodiment, the spiral has a non-constant pitch.

According to an aspect of the invention, the scrolls may be radially offset to contact in at least one point to form the at least one fluid pocket. The space between the scrolls, before they are offset, has a constant width and may be defined by a spiral form. The spiral forms discussed above may be defined by various equations.

In the case of a spiral having a non-constant pitch, the pitch may continuously and progressively decrease from an inner portion of the vanes to an outer portion of the vanes. Similarly, the walls of the vanes may have a thickness which continuously and progressively decreases from an inner portion of the vanes to an outer portion of the vanes.

Further objects, features and advantages will be understood by those having ordinary skill in the art as explained in the detailed description of the preferred embodiments with reference to the appropriate drawings.

BRIEF DESCRIPTION OF THE DRAWINGS

FIG. 3 is a diagram of a plurality of curves which define the shape of a pair of scrolls in accordance with the prior art.

FIG. 4 is a cross section of a pair of scrolls in accordance with the prior art.

FIGS. 8A and 8B are schematics representing the moment acting on an anti-rotation coupling of a scroll-type fluid displacement mechanism in accordance with the prior art.

FIG. 9 is an enlarged detail of a central portion of a scroll in accordance with the prior art.

FIG. 10 is a diagram of a spiral curve.

FIG. 11 is a cross section of a pair of scrolls in accordance with the prior art.

FIG. 12 is a longitudinal cross section of a scroll-type fluid displacement apparatus in accordance with an embodiment of the present invention.

FIG. 13 is a diagram of a spiral curve which defines the shape of a scroll in accordance with an embodiment of the present invention.

FIG. 14 is a diagram of a pair of curves which define the centerlines of the spaces between a pair of scrolls in accordance with an embodiment of the present invention.

FIG. 15 is a diagram of a plurality of curves which define the shape of a pair of scrolls in accordance with an embodiment of the present invention.

DETAILED DESCRIPTION OF THE INVENTION

Figure 1:
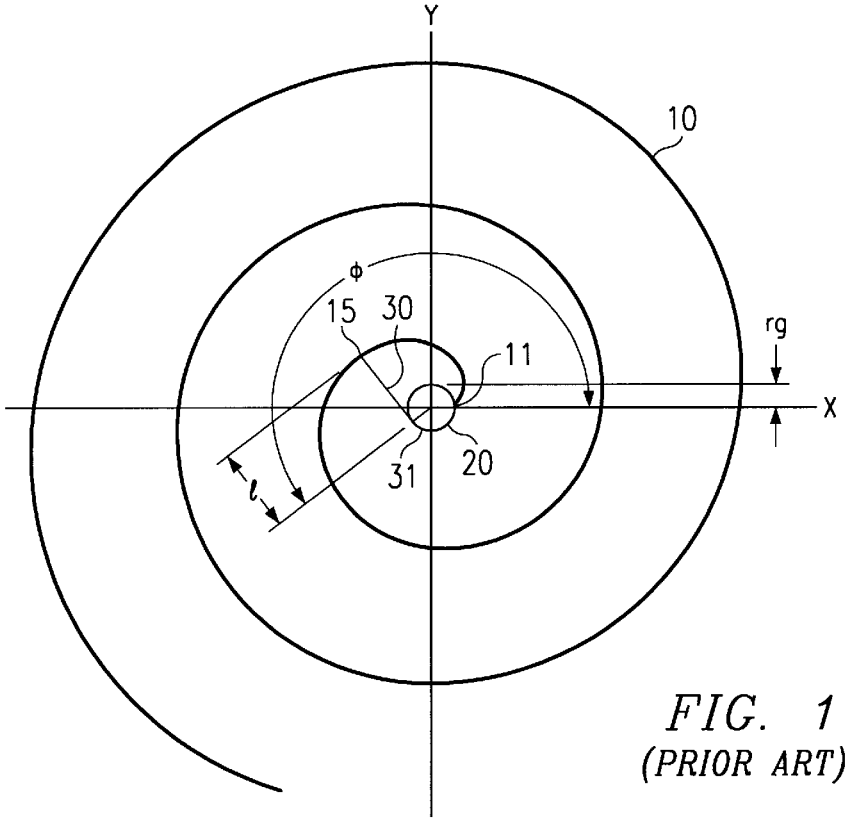
FIG. 1 (PRIOR ART)
FIG. 1 is a diagram of a curve which defines the shape of an involute curve in accordance with the prior art.
Figure 2:
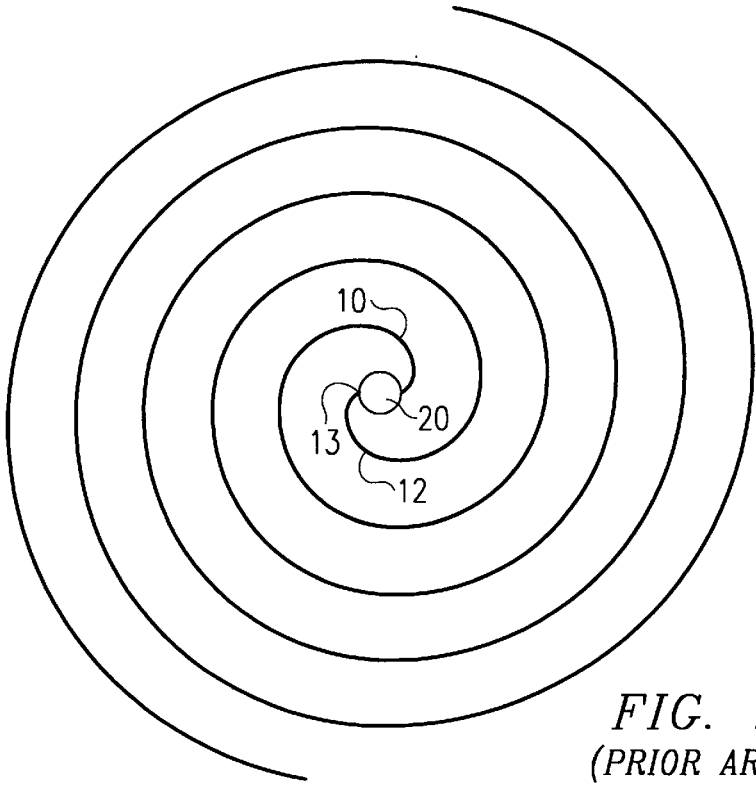
FIG. 2 (PRIOR ART)
FIG. 2 is a diagram of a pair of curves which define the shape of a pair of involute curves in accordance with the prior art.
Figure 5:
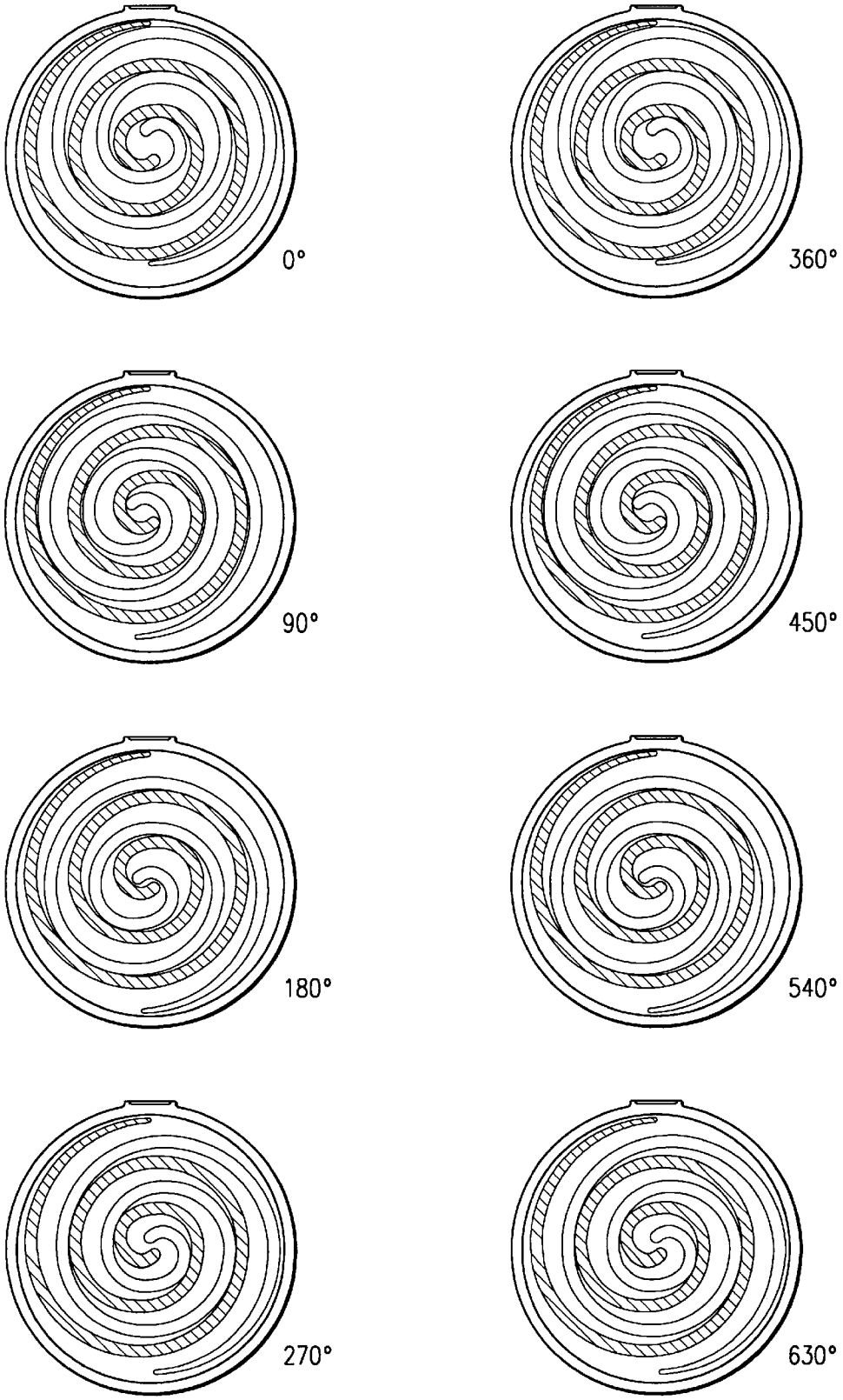
FIG. 5 (PRIOR ART)
FIG. 5 is a schematic of several cross sections of the scrolls of FIG. 4 depicting various stages of operation of a device incorporating the scrolls, and in accordance with the prior art.
Figure 6:
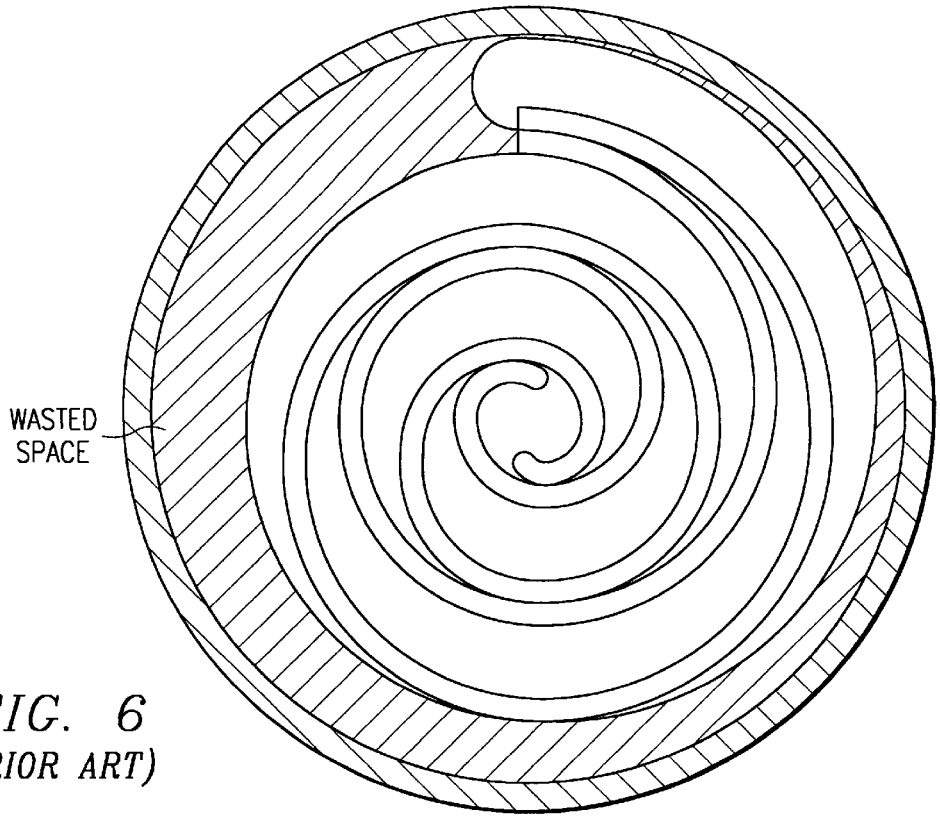
FIG. 6 (PRIOR ART)
FIG. 6 is a cross section of a pair of scrolls in accordance with the prior art.
Figure 7:
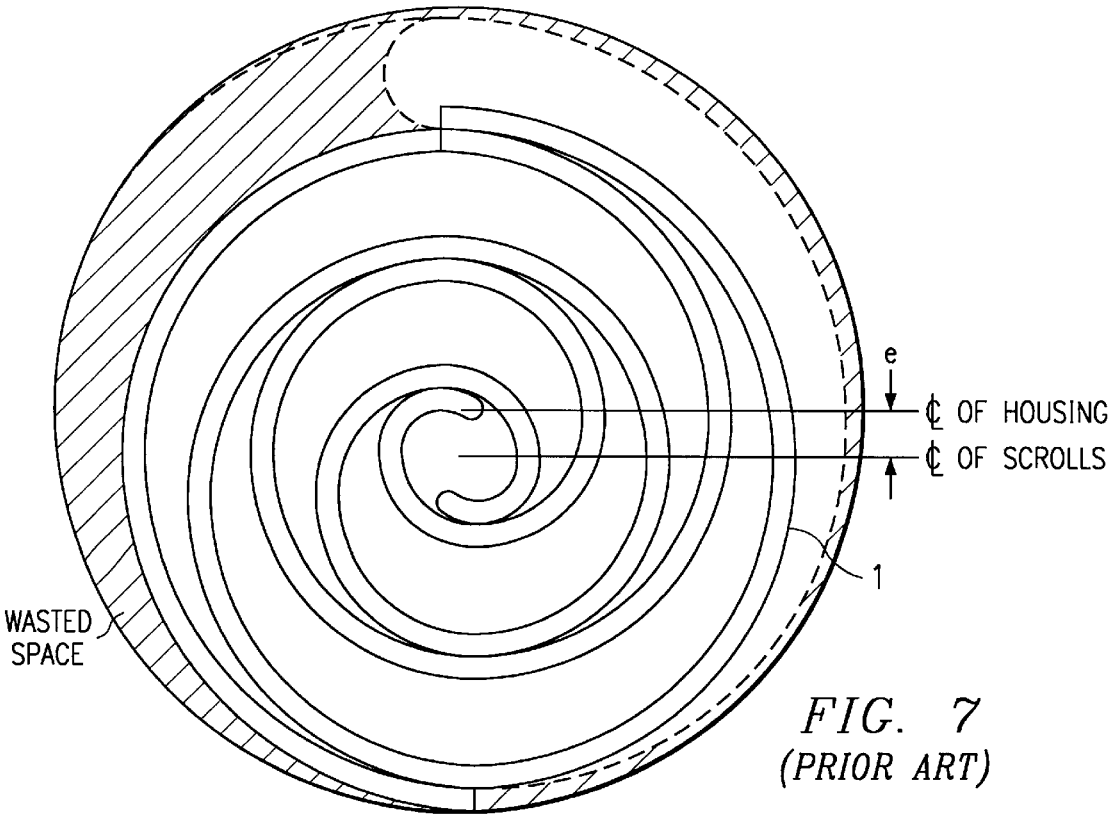
FIG. 7 (PRIOR ART)
FIG. 7 is a cross section of a pair of scrolls in accordance with the prior art.

In general, the present invention concerns providing a scroll-type fluid displacement mechanism, which preferably includes two scroll elements. Each scroll element has an end plate and a scroll extending from the end plate. The scrolls are shaped as spirals.

In an embodiment of the invention, as shown in FIG. 12, a scroll-type fluid displacement mechanism has orbiting scroll 1 and fixed scroll 2. Orbiting scroll 1 includes end plate 101 and spiral scroll 102. Fixed scroll 2 includes end plate 201 and spiral scroll 202. Spiral scrolls 102 and 202 are interleaved to form a plurality of sealed-off fluid pockets between orbiting scroll 1 and fixed scroll 2.

Fixed scroll 2 is fixedly mounted in housing 3 while orbiting scroll 1 is driven in a circular path by crankshaft 4, mounted in bearings 5 and 6. Offset bushing 7 acts through bearing 8 to impart the desired orbital motion to orbiting scroll 1. Orbiting scroll 1 is prevented from rotating about its axis by the action of anti-rotation coupling 9, which includes ball 902 and coupling rings 901 and 903. Ports 10 and 11 are provided in housing 3 for the entry and exit, respectively, of the fluid being worked upon. It will be understood by those having ordinary skill that these features can be modified according to current practice without detracting from the various aspects, features and advantages of the present invention.

With reference to FIG. 12, section line A—A provides an end-on view of the form of the spiral scrolls of the scroll elements 1 and 2. FIGS. 13, 14, 15 and 16 generally show how the shape of the spiral scrolls 102 and 202 is defined. FIG. 13 shows a spiral curve 203 of non-constant, decreasing pitch. The length of line segment "1" is determined by the basic equation $l=g(\alpha)$. According to one aspect, $1=k_1\alpha-f(\alpha)$, where "f" increases faster than $k_2\alpha$, and where $k_1$ and $k_2$ are constants. In other words $dl/d>0$ and $d^2/d\alpha^2<0$. Consequently, the distance between wraps of the spiral (i.e., the "pitch") will decrease as "$\alpha$" increases. Spiral curve 203 is defined according to this relation. The constants $k_1$ and $k_2$ and the function f are determined by the desired displacement and body diameter of a device incorporating the scrolls. It will be noted that the defining equation may be generally represented as $1=k_1\alpha-k_2\alpha^n$.

FIG. 14 shows spiral curve 203 and a mating spiral curve 204. Spiral curve 204 is identical to spiral curve 203, except for being angularly offset by 1800 about the origin point 205. In FIG. 15 can be seen the method of using curves 203 and 204 to define spiral scrolls 102 and 202. In order for the orbiting spiral scroll 102 to define a circular path of radius $R_{or}$, a constant distance $R_{or}$ must exist between orbiting spiral scroll 102 and fixed spiral scroll 202. As shown in FIG. 15, constant distance Ror is determined when scrolls 102 and 202 are formed to be centered between curves 203 and 204. Constant distance Ror thus defines a clearance space 12 between orbiting and fixed spiral wraps 102 and 202. Because the clearance space between the scroll walls is of constant width $R_{or}$, radially offsetting the orbiting scroll in any direction will result in a movement of the magnitude $R_{or}$. Consequently, when the orbiting scroll is moved in a circular path against the walls of the fixed scroll, it will describe a circle of radius $R_{or}$. This method of describing the surfaces of the scroll walls by defining the constant-width space between them allows many curves to be used to define the walls that could not be so used with the old method of defining the wall surfaces themselves. For example, as described previously, a spiral curve cannot be used to define the surfaces of the walls directly. However, if the spiral curve is used to define the centerline of the space between the scrolls, then the walls can be indirectly defined from the spiral and the compressor (or expander) will function. In other words, a cross section between the vanes of the scrolls can have a centerline defined by a spiral. The fact that the pitch of the spiral is decreasing toward the outside further increases the requirement for this type of indirect definition of the scroll wall surfaces.

During manufacture, a mold may be used according to the above description. The areas not falling within the clearance space 12 can be filled with a material used to form spiral wraps 102 and 202 as shown in FIG. 15. Because the pitch of spiral curves 203, 204 decreases toward the peripheral wraps of the scrolls, whereas the width of clearance space 12 is constant, the thickness of the scrolls decreases toward their peripheral tips. It should be noted that the above-described "mold" concept is used only as an analogy.

As described above in conjunction with FIGS. 14 and 15, spiral curves 203 and 204 are determined by a single, continuous function and are utilized in one embodiment of the present invention to define the vane walls of scrolls 102 and 202. Accordingly, as shown best in FIG. 15, each vane wall has a thickness 207*a*, 207*b* varying from a common point 206*a*, 206*b* proximate an inner portion of the vane to an outer portion of the vane (not explicitly shown), the rate of the varying of thickness 207*a*, 207*b* with respect to the angular position of the inner surface (or outer surface) being a continuous function of the angular position of the inner surface (or outer surface).

In the embodiment shown in FIG. 14 where the pitch of spiral curves 203 and 204 is decreasing toward an outer portion of the vanes, each vane wall may have thickness 207*a*, 207*b* increasing from common point 206*a*, 206*b* proximate an inner portion of the vane to an intermediate point 208*a*, 208*b* corresponding to a thickest portion of the vane, and thickness 207*a*, 207*b* decreasing from intermediate point 208*a*, 208*b* to an outer portion of the vane (not explicitly shown). The rate of the increase of thickness 207*a*, 207*b* with respect to the angular position of the inner surface (or outer surface) is a continuous function of the angular position of the inner surface (or outer surface). Similarly, the angular rate of change of thickness 207*a*, 207*b*, while increasing, may be continuous.

In yet another embodiment of the present invention, each vane may have a distance between its inner and outer walls (i.e., thickness 207*a*, 207*b*) that is zero at common point 206*a*, 206*b* proximate an inner portion of the vane, the second derivative of the distance between the inner and outer wall with respect to the angular position of the inner wall (or outer wall) being less than zero from common point 206*a*, 206*b* to intermediate point 208*a*, 208*b*.

Figure 16:
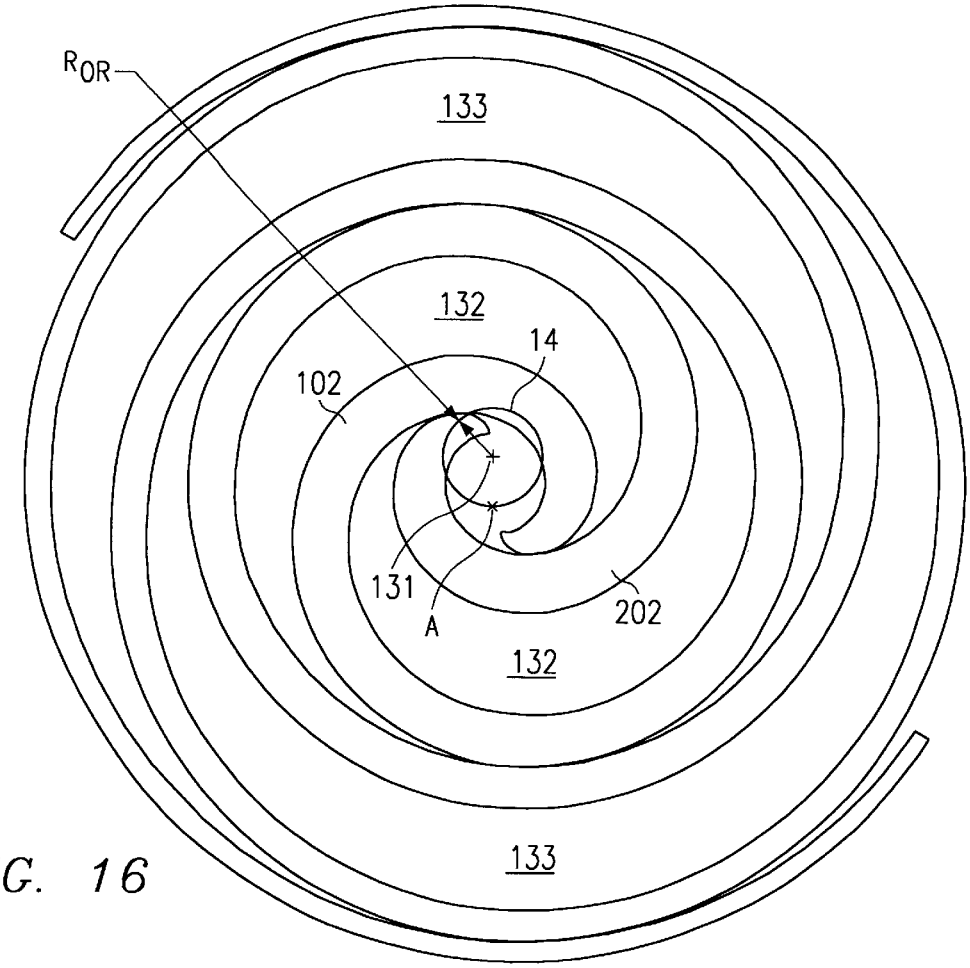
FIG. 16 is a cross section of a pair of scrolls in accordance with an embodiment of the present invention.

FIG. 16 shows orbiting scroll 102 offset by the orbiting radius $R_{or}$ so as to form fluid pockets 131, 132, 133. Point A shows the instantaneous position of the origin point of orbiting scroll 102. Circle 14 has radius $R_{or}$ and is defined by the path of the origin point of orbiting scroll 102 as it moves about in its orbital motion.

In a compression operation, fluid pockets 131, 132 and 133 will move toward the center of the pair of scrolls and the fluid in them will be compressed and expelled in the typical manner of operation of a scroll-type compressor. The thickness of the scroll wraps increases in a progressive manner toward the center of the scroll pair, so that at the outer ends, where gas loads are relatively small, a minimum amount of space is occupied by the walls of the scrolls. This leaves a maximum amount of empty space within the housing for the formation of fluid pockets. At the inner ends of the wraps, the wall thickness is substantially increased so as to resist the relatively higher gas loads in that area. Further, the increase in wall thickness occurs in a progressive manner, so that the compression process is smoother than if the wall thickness changed in a stepwise manner, for example. If the scrolls are used in a fluid expander, fluid may be introduced into the scrolls near a central portion thereof. The relative motion of the scrolls is such that the fluid pockets migrate outwards, thereby expanding the fluid.

The outer walls of the scroll wraps conform more closely to the contour of the circular housing than if they were defined by a constant-pitch involute curve. The rate of increase of "1" with respect to "$\alpha$" (see FIG. 13) is $dl/d\alpha = k_1 - df(\alpha)/d\alpha$ for the decreasing-pitch spiral curve. For a constant-pitch involute curve, on the other hand, $dl/d\phi = r_g$ (constant). For a circle, $dl/d\alpha = 0$. Because $df(\alpha)/d\alpha > 0$, the contour of the decreasing-pitch spiral is closer to that of the circular housing than the contour of the constant-pitch involute.

In the case of the prior art (e.g., described in FIG. 11), in the attempt to fit the two scrolls most efficiently into the circular space available, the two scrolls are not symmetrical to each other. As a result, the fluid pockets are not identical in size and volume at any given crank angle. Consequently, the forces created by the displacement (e.g., compression) of fluid within the fluid pockets are not balanced within the scroll pair. Because the scrolls of this embodiment of the present invention are identical in shape, the forces attendant on the compression of the fluid are equal and opposite. This creates a condition of balance within an apparatus incorporating the scroll mechanism.

Also, in the case of the prior art (e.g., described in FIG. 11), if one attempts to fit the two scrolls most efficiently into the space available, one might design the outer portion of the fixed scroll to be circular in shape and the innermost portion as a conventional circular involute. However, in order to join the two segments, it is necessary to devise a special curve to satisfy the following boundary conditions:

(1) $dl/d\phi$ (special curve)=0 l (special curve)=l (circular portion) at the union of the special curve and the circular portion (2) $dl/d\phi$ (special curve)=$dl/d\phi$ (involute) l (special curve)=l (involute) at the union of the special curve and the involute This results in a relatively rough transition between the inner and outer portions of the scrolls. By contrast, in an embodiment of the present invention, $l = k_1\alpha - f(\alpha)$ where $f(\alpha)$ is a function which increases faster than a linear function of "$\alpha$". The function l describes the centerline of the space between the scroll walls for the entire length of the scroll walls. Because a single, continuous function is used for the entire length of the scroll walls, the pocket volume and pressure change in a smooth manner through the entire orbit of the orbiting scroll. This results in a smooth and uniform transition along the entire length of the scrolls. In the embodiment described above, for example, $f(\alpha) = k_2\alpha^2$ may be used. Of course, other functions (e.g., cubic, exponential, etc.) could also be used so that the defining equation may be generally represented as $l = k_1\alpha - k_2\alpha^n$.

Figure 17:
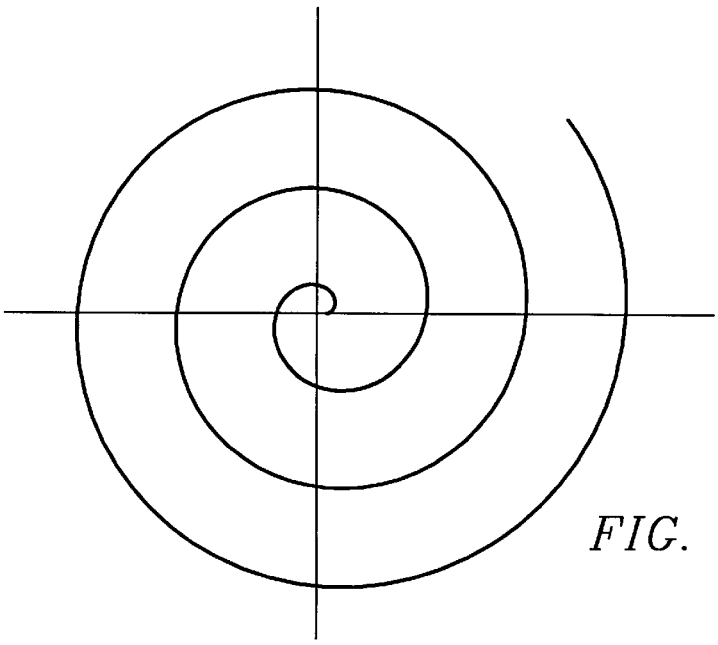
FIG. 17 is a diagram of a constant-pitch spiral curve.

The invention is not limited to spirals with non-constant pitch. For instance, the centerline of the space between the first and second vanes may be defined by a spiral having a constant pitch. Such a curve is shown, for example, in FIG. 17.

Although the present invention has been described in connection with the preferred embodiments, the invention is not limited thereto. It will be understood by those of ordinary skill in the art that variations and modifications can be easily made without departing from the scope and spirit of the present invention as defined by the following claims. For example, the scroll walls described herein could be used in a fluid expansion device to achieve similar benefits.

What is claimed is:

1. An apparatus for displacing a fluid, the apparatus comprising:

a first scroll having a first vane;

a second scroll having a second vane;

the first vane interleaved with the second vane to form at least one fluid pocket within the interleaved vanes;

means for entry of the fluid into the at least one fluid pocket;

means for exit of the fluid from the at least one fluid pocket; and means coupled to at least one of the scrolls for causing a relative orbital motion between the first and second scrolls, wherein the relative orbital motion causes the at least one fluid pocket to be displaced, and wherein each of the first and second vanes comprises inner and outer surfaces defining a wall, each wall having a thickness varying from a common point proximate an inner portion of the vane to an outer portion of the vanes, the rate of the varying of the thickness with respect to the angular position of the inner surface being a continuous function of the angular position of the inner surface.

2. The apparatus of claim 1, wherein the rate of the varying of the thickness with respect to the angular position of the outer surface being a continuous function of the angular position of the outer surface.

3. An apparatus for displacing a fluid, the apparatus comprising:

a first scroll having a first vane;

a second scroll having a second vane;

the first vane interleaved with the second vane to form at least one fluid pocket within the interleaved vanes;

means for entry of the fluid into the at least one fluid pocket;

means for exit of the fluid from the at least one fluid pocket; and means coupled to at least one of the scrolls for causing a relative orbital motion between the first and second scrolls, wherein the relative orbital motion causes the at least one fluid pocket to be displaced, and wherein each of the first and second vanes comprises inner and outer surfaces defining a wall, each wall having a thickness increasing from a common point proximate an inner portion of the vane to an intermediate point corresponding to a thickest portion of the vane, the thickness decreasing from the intermediate point of the vane to an outer portion of the vane, the rate of the increase of the thickness with respect to the angular position of the inner surface being a continuous function of the angular position of the inner surface.

4. The apparatus of claim 3, wherein the rate of the increase of the thickness with respect to the angular position of the outer surface is also a continuous function of the angular position of the outer surface.

5. An apparatus for displacing a fluid, the apparatus comprising:

a first scroll having a first vane;

a second scroll having a second vane;

the first vane interleaved with the second vane to form at least one fluid pocket within the interleaved vanes;

means for entry of the fluid into the at least one fluid pocket;

means for exit of the fluid from the at least one fluid pocket; and means coupled to at least one of the scrolls for causing a relative orbital motion between the first and second scrolls, wherein the relative orbital motion causes the at least one fluid pocket to be displaced, and wherein each of the first and second vanes comprises inner and outer surfaces defining a wall, each wall having a thickness increasing from a common point proximate an inner portion of the vane to an intermediate point corresponding to a thickest portion of the vane, the thickness decreasing from the intermediate point of the vane to an outer portion of the vane, the angular rate of change of the increasing thickness being continuous.

6. An apparatus for displacing a fluid, the apparatus comprising:

a first scroll having a first vane;

a second scroll having a second vane;

the first vane interleaved with the second vane to form at least one fluid pocket within the interleaved vanes;

means for entry of the fluid into the at least one fluid pocket;

means for exit of the fluid from the at least one fluid pocket; and means coupled to at least one of the scrolls for causing a relative orbital motion between the first and second scrolls, wherein the relative orbital motion causes the at least one fluid pocket to be displaced, and wherein each of the first and second vanes comprises an inner and outer wall, the distance between the inner and outer wall being zero at a common point proximate an inner portion of the vane, the second derivative of the distance between the inner and outer wall with respect to the angular position of the inner wall being less than zero from the common point to an intermediate point corresponding to a thickest portion of the vane.

7. The apparatus of claim 6, wherein the second derivative of the distance between the inner and outer wall with respect to the angular position of the outer wall is less than zero from the common point to an intermediate point corresponding to a thickest portion of the vane.

* * * * *